US006255767B1

(12) United States Patent
Lee et al.

(10) Patent No.: US 6,255,767 B1
(45) Date of Patent: Jul. 3, 2001

(54) ELECTRODE GUN WITH GRID ELECTRODE HAVING CONTOURED APERTURES

(75) Inventors: Joo Il Lee, Chungcheongbuk-do; Yu Sung Nam, Kwangmyung-si, both of (KR)

(73) Assignee: Orion Electric Co., Ltd., Kyungsangbuk-do (CN)

( * ) Notice: Subject to any disclaimer, the term of this patent is extended or adjusted under 35 U.S.C. 154(b) by 0 days.

(21) Appl. No.: 09/200,225

(22) Filed: Nov. 25, 1998

(30) Foreign Application Priority Data

Nov. 29, 1997 (KR) ..... 97-64870
Nov. 29, 1997 (KR) ..... 97-64966

(51) Int. Cl.[7] ..... H01J 29/56
(52) U.S. Cl. ..... 313/414; 313/412
(58) Field of Search ..... 313/414, 412, 313/409, 421, 426

(56) References Cited

U.S. PATENT DOCUMENTS 4,583,024 * 4/1986 Chen ..... 313/414
4,584,500 4/1986 Day ..... 313/414
4,626,738 12/1986 Gerlach ..... 313/414
5,142,189 8/1992 Sugahara et al. ..... 313/414
5,170,101 * 12/1992 Gorski et al. ..... 313/412
5,466,983 * 11/1995 Shirai et al. ..... 313/414
5,488,265 * 1/1996 Chen ..... 313/414
5,734,235 * 3/1998 Noguchi ..... 313/414
5,883,463 * 3/1999 KiKuchi et al. ..... 313/414

FOREIGN PATENT DOCUMENTS 0283941 9/1988 (EP) ..... H01J/29/62
0441486 8/1991 (EP) ..... H01J/29/62
0469540 2/1992 (EP) ..... H01J/29/48
0624894 11/1994 (EP) ..... H01J/29/50

* cited by examiner

*Primary Examiner*—Michael H. Day
(74) *Attorney, Agent, or Firm*—Notaro & Michalos P.C.

(57) ABSTRACT

An electron gun has a plurality of grid electrodes for focusing electron beams radiated from cathodes, at least one of said grid electrodes having a cylindrical body containing a plate member. The plate member has a central electron-beam-passing-aperture and two side apertures. At least one of the two side apertures is contoured by a first circular arc and a second circular arc, two first vertical lines respectively extending outward from either ends of the first circular arc, two second vertical lines respectively extending outward from either ends of the second circular arc, and two connecting lines respectively connecting each of outer ends of the first vertical lines to each of outer ends of the second vertical lines. The electron gun improves the degree of freedom in controlling shapes of beam spots focused on a phosphor screen, thereby heightening the resolution of the cathode ray tube.

5 Claims, 10 Drawing Sheets non-symmetric ellipse partly cut-away ellipse rectangle

ELECTRODE GUN WITH GRID ELECTRODE HAVING CONTOURED APERTURES

BACKGROUND OF THE INVENTION

1. Field of the Invention

The present invention relates to an electron gun for a cathode ray tube, which has a grid electrode having apertures of improved shapes to form an improved main lens of the electron gun, thereby increasing the degree of freedom in controlling the shapes of the beam spots focused on the phosphor screen, and improving the shape of the electric field formed in the main lens to thereby improve various focusing characteristics of the electron gun. The present invention further relates to an electron gun for a cathode ray tube, which can compensate for the astigmatism caused by the enlarged focusing lens and can advantageously control the static convergence.

2. Prior Arts

In general, an electron gun of a cathode ray tube is an apparatus for radiating three electron beams through a mask so as to form a predetermined image on a phosphor screen. FIG. 1 is a schematic constructional view of the conventional in-line type electron gun for describing its construction and operation. Referring to FIG. 1, in the conventional in-line type electron gun, thermions radiated from a cathode 1 are attracted to a control grid G1 by the voltage applied to a screen grid G2, with forming electron beams. Then, the electron beams pass through a prefocus lens 2 formed between the screen grid G2 and a focusing grid G3 and then proceed into a main lens 3 formed between the focusing grid G3 and an accelerating grid G4. The electron beams focused by the main lens 3 pass through a shadow mask 4 and then form beam spots on a phosphor screen 5 of a panel faceplate 6.

In the meantime, a large-sized color cathode ray tube is increasingly demanded and is trending towards a flat shape. Therefore, it requires a high anode voltage in order to obtain focused spots on the screen with constantly maintaining the speed of the electron beams from the cathode. A high voltage difference between this high anode voltage and the focusing voltage forms an electrostatic lens with a shorter focal distance, which is capable of causing an aberration. Further, when the electron beams pass through the deflection yoke to be deflected to the peripheral portions of the screen by the deflection magnetic field, the distribution of the deflection magnetic field makes the electron beams be under-focused in the horizontal direction and over-focused in the vertical direction.

In order to compensate for the deterioration of the resolution at the peripheral portions of the screen by the above described effects, the conventional electron gun has rim electrodes opposed to each other to form the main lens. Moreover, in the conventional electron gun, the electrode plates having apertures are disposed in positions retreated from the rim electrodes, and the apertures respectively have a shape of a vertically elongated ellipse.

FIG. 2 shows a schematic perspective view of a conventional in-line type electron gun a part of which is cut away. In the conventional in-line type electron gun shown in FIG. 2, the main lens is formed between the G5-2 and the G6 electrodes which contain plate members 22 and 24 respectively having apertures of vertically elongated elliptic shapes.

Also, in the conventional in-line type electron gun as constructed above, the shapes of the beam spots focused on the phosphor screen are elongated in the horizontal direction, which deteriorates the resolution at the peripheral portions of the screen. Although the conventional electron gun also has apertures of vertically elongated elliptic shapes as shown in FIG. 3 in order to eliminate this problem, the resolution at the peripheral portions of the screen does not get improved yet.

In the meantime, the diameter of the main lens of the electron gun generally has a large effect on the focusing characteristic of the color cathode ray tube. In other words, when the diameter of the main lens is small, the spherical aberration of the main lens not only lowers down the resolution at the peripheral portions of the screen but also deteriorates various characteristic in relation to the resolution. Therefore, the larger the diameter of the main lens is, the higher the resolution of the screen is.

However, there is a limit to the size of the neck of the color cathode ray tube in which the electron gun is installed, and therefore, there is a limit to the size of the apertures for forming the main lens. Further, the above inherent structural limit to the size of the apertures becomes more severe nowadays because the diameter of the neck of the color cathode ray tube has a tendency to decrease in order to obtain various advantages such as reduction of the manufacturing cost of the color cathode ray tube, and reduction of the exhaustion of electric power by employing a small-sized deflection yoke.

Several prior arts including U.S. Pat. Nos. 4,583,024, 4,766,344, 4,833,364, and 5,414,323 disclose apertures of various shapes such as a non-symmetric ellipse, a partly cut-away ellipse, a rectangle and a key hole, as shown in FIG. 4, in order to overcome the deterioration of the resolution at the peripheral portions of the screen as described above. The apertures of the proposed shapes achieve the above object of overcoming the deterioration of the resolution to a certain degree. However, the above patents do not pay attention to the influence of the side walls of the grid electrodes on the main lens. Moreover, the above patents do not improve entire focusing characteristics including the degree of freedom in controlling the shape of beam spots in the horizontal and the vertical directions by controlling the shapes of the apertures such as a key hole.

Furthermore, although enlarged main focusing lens has a reduced spherical aberration by providing an easy slope of voltage and although vertical and horizontal beams can reduce the astigmatism, it is difficult to install the electrodes for the main focusing lens at positions retreated a predetermined distance from the rim electrodes.

Moreover, when the electrodes for the main focusing lens are disposed at positions retreated a predetermined distance from the rim electrodes, the horizontal beams make distorted spots because there happens a difference between focusing forces in the directions of the central beam and the side beams.

SUMMARY OF THE INVENTION

The present invention has been made to overcome the above described problems of the prior arts, and accordingly it is an object of the present invention to provide an electron gun for a cathode ray tube, which improves the freedom of degree to control shapes of beam spots focused on a phosphor screen, thereby heightening the resolution of the cathode ray tube.

It is another object of the present invention to provide an electron gun for a cathode ray tube, which reduces an influence of cylindrical side walls of grid electrodes to electric fields of a main lens, thereby improving shapes of beam spots at peripheral portions of a phosphor screen and improving the focusing uniformity through central and peripheral portions of the phosphor screen.

It is another object of the present invention to provide an electron gun for a cathode ray tube, in which the convergence drift according to the focus voltage variance is largely reduced, so that it is easy to maintain the white balance even when the luminance is largely changed, and which reduces a variance of the resolution according to a change of the cathode current.

To achieve the above object, the present invention provides an electron gun for a cathode ray tube, the electron gun comprising a plurality of grid electrodes for focusing electron beams radiated from cathodes, at least one of said grid electrodes having a cylindrical body containing a plate member, the plate member having a central aperture and two side apertures, at least one of the two side apertures being contoured by at least one curve, straight lines connected to the curve, and connecting lines connecting the straight lines.

Preferably, each of the two side apertures is contoured by a first circular arc and a second circular arc, two first vertical lines respectively extending outward from either ends of the first circular arc, two second vertical lines respectively extending outward from either ends of the second circular arc, and two connecting lines respectively connecting each of outer ends of the first vertical lines to each of outer ends of the second vertical lines. The two connecting lines are horizontal lines.

According to another embodiment, the first circular arc is a part of a first imaginary circle, and the second circular arc is a part of a second imaginary circle, the first imaginary circle and the second imaginary circle being concentric circles, the first imaginary circle having a larger diameter than the second imaginary circle, the first circular arc and the second circular arc being opposed to each other, and the second circular arc being disposed near the central aperture. The two connecting lines may be two third arcs which are parts of a third imaginary circle, and the first imaginary circle and the second imaginary circle are eccentric to each other. More preferably, the third imaginary circle has a larger diameter than the first imaginary circle.

According to another embodiment, the first imaginary circle and the second imaginary circle are eccentric to each other.

Another embodiment of the present invention provides an electron gun for a cathode ray tube, the electron gun radiating three electron beams to be directed toward a phosphor screen through three apertures, the electron gun comprising at least two bi-pole electrodes opposed to each other, the two bi-pole electrodes forming a main lens for focusing the three electron beams, the two bi-pole electrodes respectively containing a plate electrode having said three apertures, the two bi-pole electrodes being rim electrodes having an equal size to each other.

BRIEF DESCRIPTION OF THE DRAWINGS

The above object, and other features and advantages of the present invention will become more apparent by describing in detail preferred embodiments thereof with reference to the attached drawings, in which.

DESCRIPTION OF THE PREFERRED EMBODIMENTS

Hereinafter, several preferred embodiments of the present invention will be described in detail with reference to the accompanying drawings.

Figure 5:
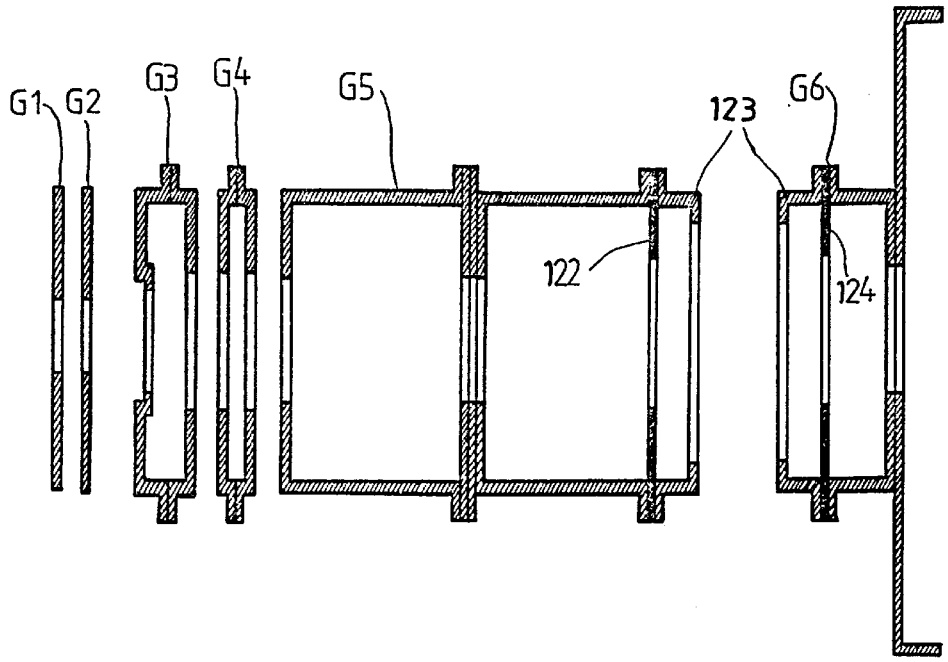
FIG. 5 is a schematic constructional view of an in-line type electron gun according to an embodiment of the present invention.

In FIG. 5, which shows a schematic construction of an in-line type electron gun according to an embodiment of the present invention, a cathode for radiating electron beams is not shown, while reference numerals G1 and G2 respectively designate a first grid electrode for controlling the radiated electron beams and a second grid electrode for accelerating the electron beams. Further, reference numerals G3, G4, G5, and G6 respectively designate a third, a fourth, a fifth, and a sixth grid electrodes for respectively focusing the electron beams.

A first prefocus lens is formed between apertures of the second grid electrode G2 and apertures of the third grid electrode G3. apertures of the third and the fourth grid electrodes G3 and G4, and lower electrode apertures of the fifth grid electrode G5 together form a second prefocus lens, while upper side apertures of the fifth grid electrode G5 and apertures of the sixth grid electrode G6 form a main lens.

The fifth and sixth grid electrodes G5 and G6 respectively have a rim electrode 123 for enlarging the diameter of the main lens and respectively contain a first and a second plate members 122 and 124 for focusing the electron beams. The first and the second plate members 122 and 124 respectively have three apertures.

Figure 6:
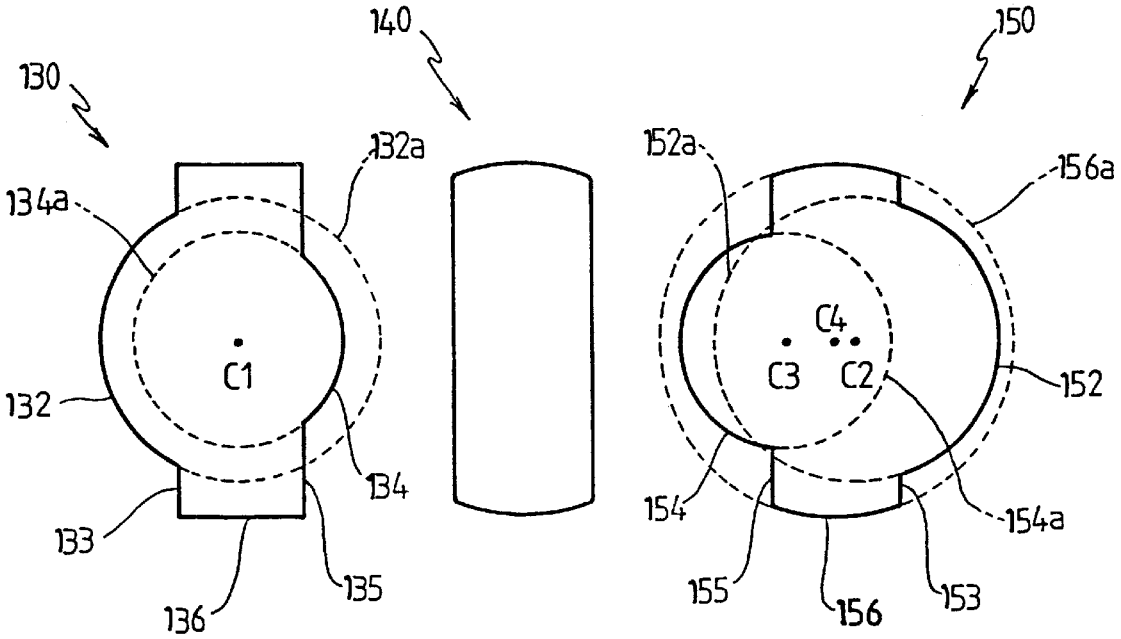
FIG. 6 is a view for showing various shapes of apertures employed in the electron gun according to the embodiment of the present invention shown in FIG. 5.

FIG. 6 shows three apertures 130, 140, and 150 formed at the first and the second plate members 122 and 124 according to the embodiment of the present invention shown in FIG. 5. Although FIG. 6 simultaneously shows one central aperture 140 and two side apertures 130 and 150 respectively according to the first and the second embodiments of the present invention, other embodiments of the present invention may employ only one kind of side apertures 130 or 150 disposed at both sides of the central aperture 140. The central aperture 140 is contoured by an upper arc and a lower arc, and two vertical lines respectively connecting the upper and the lower arcs. The central aperture 140 may have another contour according to other embodiments of the present invention.

The first side aperture 130 is contoured by a first circular arc 132 and a second circular arc 134, two first vertical lines 133 connected to the first circular arc 132 and two second vertical lines 135 connected to the second circular arc 134, and two horizontal lines 136 respectively connecting each of the first vertical lines 133 to each of the second vertical lines 135. The first circular arc 132 is a part of a first imaginary circle 132*a,* and the second circular arc 134 is a part of a second imaginary circle 134*a*. The first imaginary circle 132*a* and the second imaginary circle 134*a* are concentric circles having the same center C1. The first imaginary circle 132*a* has a larger diameter than the second imaginary circle 134*a*. The first circular arc 132 and the second circular arc 134 are opposed to each other, and the second circular arc 134 is disposed at the side near to the central aperture 140.

The two first vertical lines 133 respectively extend outward from either ends of the first circular arc 132, while the two second vertical lines 135 respectively extend outward from either ends of the second circular arc 134. Each of outer ends of the first vertical lines 133 is connected to each of outer ends of the second vertical lines 135 through each of the horizontal lines 136. Lengths of the first vertical lines 133, the second vertical lines 135, and the horizontal lines 136 may be properly selected.

Reference numeral 150 designates the second side aperture according to the second embodiment of the present invention as mentioned above.

The second side aperture 150 is contoured by a first circular arc 152 and a second circular arc 154, two first vertical lines 153 connected to the first circular arc 152 and two second vertical lines 155 connected to the second circular arc 154, and two third circular arcs 156 respectively connecting each of the first vertical lines 153 to each of the second vertical lines 155. The first circular arc 152 is a part of a first imaginary circle 152*a,* the second circular arc 154 is a part of a second imaginary circle 154*a,* and the third circular arcs 156 are parts of a third imaginary circle 156*a*. The first imaginary circle 152*a,* the second imaginary circle 154*a,* and the third imaginary circle 156*a* are eccentric circles respectively having different centers C1, C2, and C3. The center C3 of the third imaginary circle 156*a* plays a role of the center of the second side aperture 150. The first imaginary circle 152*a* has a larger diameter than the second imaginary circle 154*a,* and the third imaginary circle 156*a* has a larger diameter than the first imaginary circle 152*a*. The first circular arc 152 and the second circular arc 154 are opposed to each other, and the second circular arc 154 is disposed at the side near to the central aperture 140.

The two first vertical lines 153 respectively extend outward from either ends of the first circular arc 152, while the two second vertical lines 155 respectively extend outward from either ends of the second circular arc 154. Each of outer ends of the first vertical lines 153 is connected to each of outer ends of the second vertical lines 155 through each of the horizontal lines 156. Lengths of the first and the second vertical lines 153 and 155, and distance between the first and the second vertical lines 153 and 155 may be properly selected.

Hereinafter, the operation of the in-line type electron gun according to the above embodiments of the resent invention will be described in detail.

Figure 1:
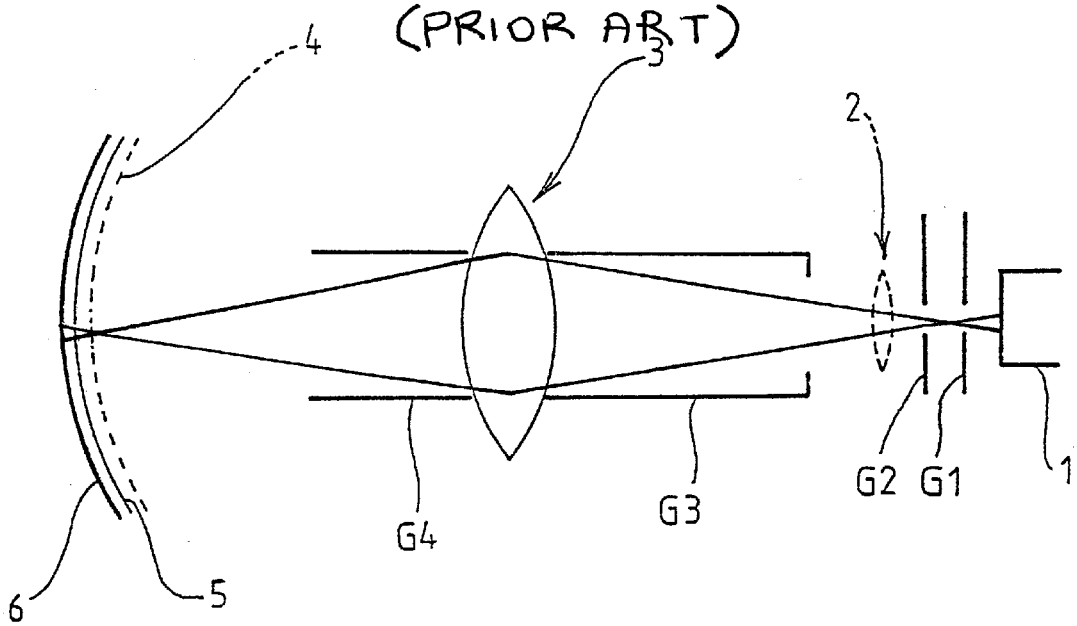
FIG. 1 (PRIOR ART)
FIG. 1 is a schematic constructional view of the conventional in-line type electron gun for describing its construction and operation.
Figure 2:
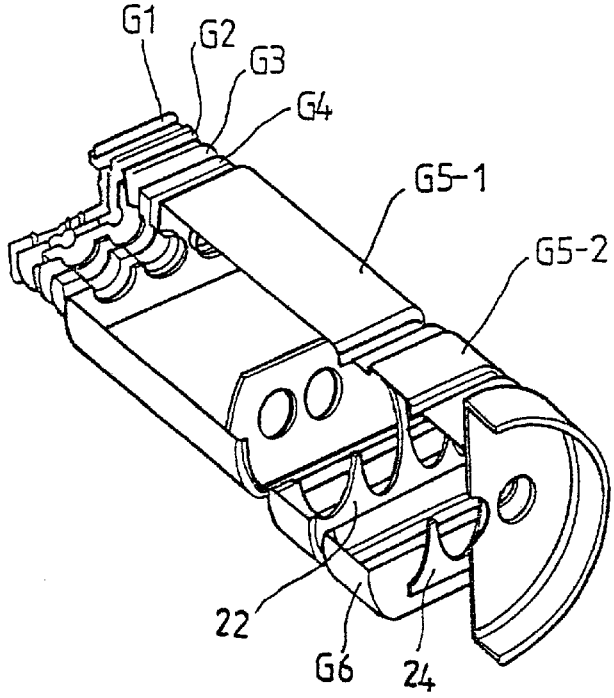
FIG. 2 (PRIOR ART)
FIG. 2 is a schematic perspective view of a conventional in-line type dynamic focusing electron gun a part of which is cut away.
Figure 3:
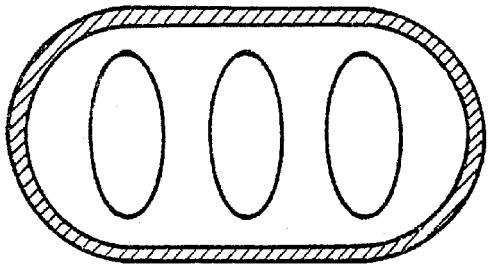
FIG. 3 (PRIOR ART)
FIG. 3 is a front view of a plate electrode having elliptical apertures employed in the conventional in-line type electron gun as shown in FIG. 1 and FIG. 2.
Figure 4:
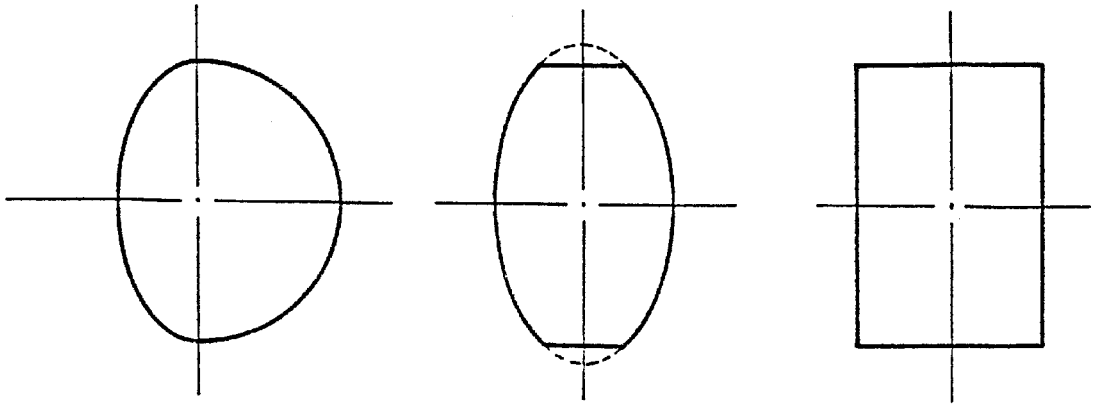
FIG. 4 (PRIOR ART)
FIG. 4 is a view for showing various shapes of the apertures employed in the conventional electron gun.

Referring to FIG. 2 and FIG. 5, three electron beams of red, green and blue radiated from a cathode (not shown) are prefocused while passing through the prefocus lenses formed by apertures of the second, the third, and the fourth grid electrodes G2, G3, and G4, and the lower electrode apertures of the fifth grid electrode G5. Thereafter, these electron beams are focused by passing through the main lens to form beam spots on a phosphor screen (not shown) of the color cathode ray tube through a shadowmask (not shown).

While the election beams pass through the main lens, the rim electrode 123 and the plate members 122 and 124 enlarge the diameter of the main lens to reduce the spherical aberration and have an effect on the distribution of the electric field of the main lens to thereby improve the focusing characteristics and increase the freedom of degree in controlling shapes of beam spots focused on a phosphor screen.

That is, the shapes of the beam spots may be controlled properly and freely by determining proper lengths of the first and the second vertical lines 153 and 155, and a proper distance between the first and the second vertical lines 153 and 155, which helps to heighten the resolution of the phosphor screen of the color cathode ray tube.

Further, the shapes of the beam spots may also be controlled by properly determining the diameters of the imaginary circles 132*a,* 152*a,* 134*a,* 154*a,* and 156*a*.

In the meantime, shapes of the electric fields formed by the apertures 130, 140, and 150 are influenced by cylindrical side walls of the fifth and the sixth grid electrodes G5 and G6, because the plate members 122 and 124 are contained in the fifth and the sixth grid electrodes G5 and G6 of cylindrical shapes. In this case, the first circular arcs 132 and 152 disposed near the cylindrical walls of the fifth and the sixth grid electrodes G5 and G6 respectively have a larger curvature than the second circular arcs 134 and 154 disposed near the central aperture 140, as described above and shown in FIG. 6. This construction reduces the influence of the cylindrical walls on the electric field, thereby improving shapes of beam spots at peripheral portions of a phosphor screen and improving the focusing uniformity through central and peripheral portions of the phosphor screen by reducing halo components.

Furthermore, the above described improvement of the shapes of the electric fields enables reduction of convergence drift according to the variance of the applied focus voltage, which makes it easy to maintain the white balance even when the luminance is largely changed. That is, allowance for the change of the luminance is enlarged in maintaining the white balance.

Figure 7:
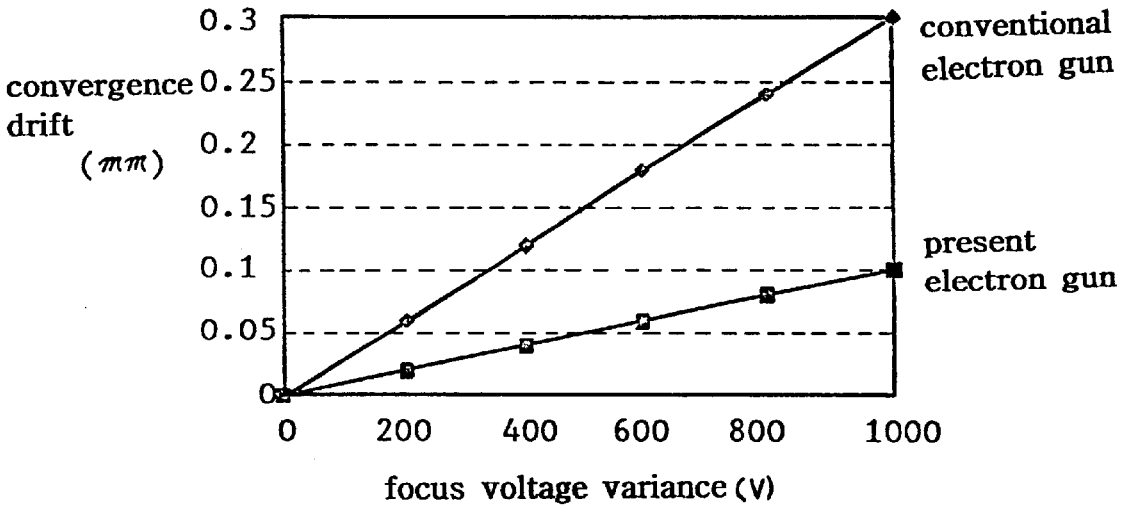
FIG. 7 is a graph for comparing a convergence drift according to the focus voltage variance in the electron gun of the present invention with that in the conventional electron gun.

Table 1 and FIG. 7 are a table and a graph for comparing a convergence drift according to the focus voltage variance in the electron gun of the present invention with that in the conventional electron gun by a computer simulation.

TABLE 1

| convergence drifts according to the focus voltage variance | | |
|---|---|---|
| focus voltage variance | conventional electron gun | electron gun of the invention |
| 0 | 0.00 | 0.00 |
| 200 | 0.06 | 0.02 |
| 400 | 0.12 | 0.04 |
| 600 | 0.18 | 0.06 |
| 800 | 0.24 | 0.08 |
| 1000 | 0.30 | 0.10 |

Figure 8:
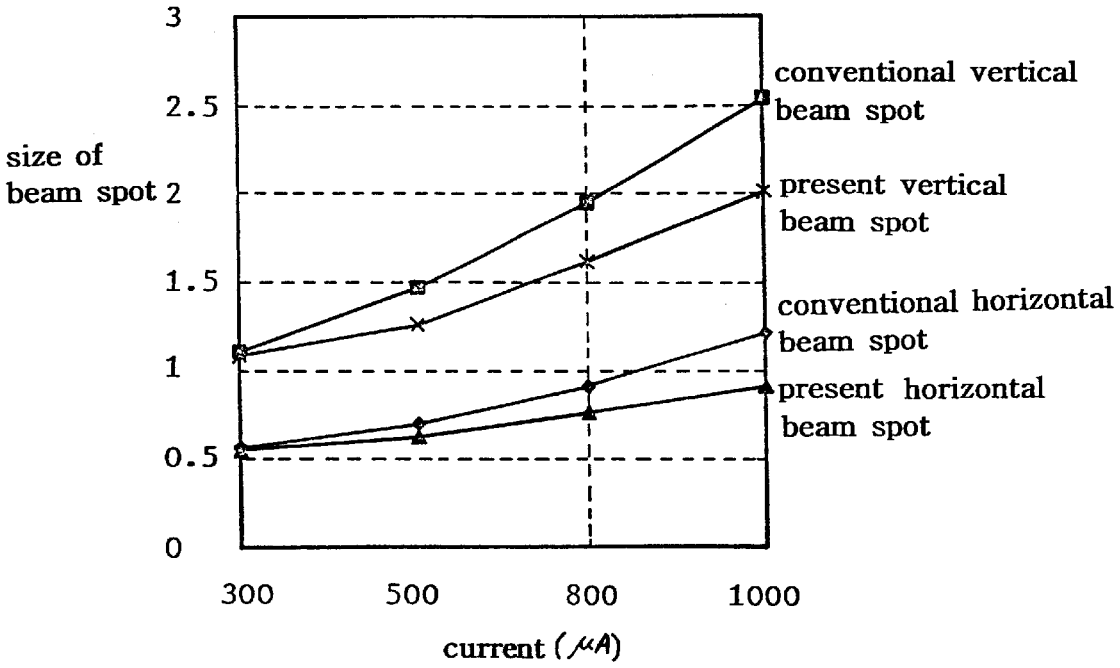
FIG. 8 is a graph for comparing sizes of beam spots according to a change of the cathode current in the electron gun of the present invention with those in the conventional electron gun.

Meanwhile, the above described improvement of the shapes of the electric fields provides another advantage of the reduction of the variance of the resolution according to a change of the cathode current, which improvement is shown in table 2 and FIG. 8. In table 2 and FIG. 8, the current means the cathode current having a unit of microampere, and a red beam at the screen center is employed for measuring the beam spot size whose unit is millimeter (mm). The rate of improvement means the improved ratio of the resolution or the luminance obtained by comparing the horizontal axes of the beams. The unit of the rate is percent %.

TABLE 2

| sizes of beam spots according to the cathode current | | | | | |
|---|---|---|---|---|---|
| | conventional beam spot | | beam spot of the invention | | rate of |
| current | horiz. width | vert. width | horiz. width | vert. width | improvement |
| 300 | 0.569 | 1.107 | 0.554 | 1.088 | 2.6 |
| 500 | 0.704 | 1.471 | 0.635 | 1.263 | 10.0 |
| 800 | 0.923 | 1.952 | 0.771 | 1.623 | 16.0 |
| 1000 | 1.213 | 2.538 | 0.918 | 2.014 | 24.0 |

Figure 9:
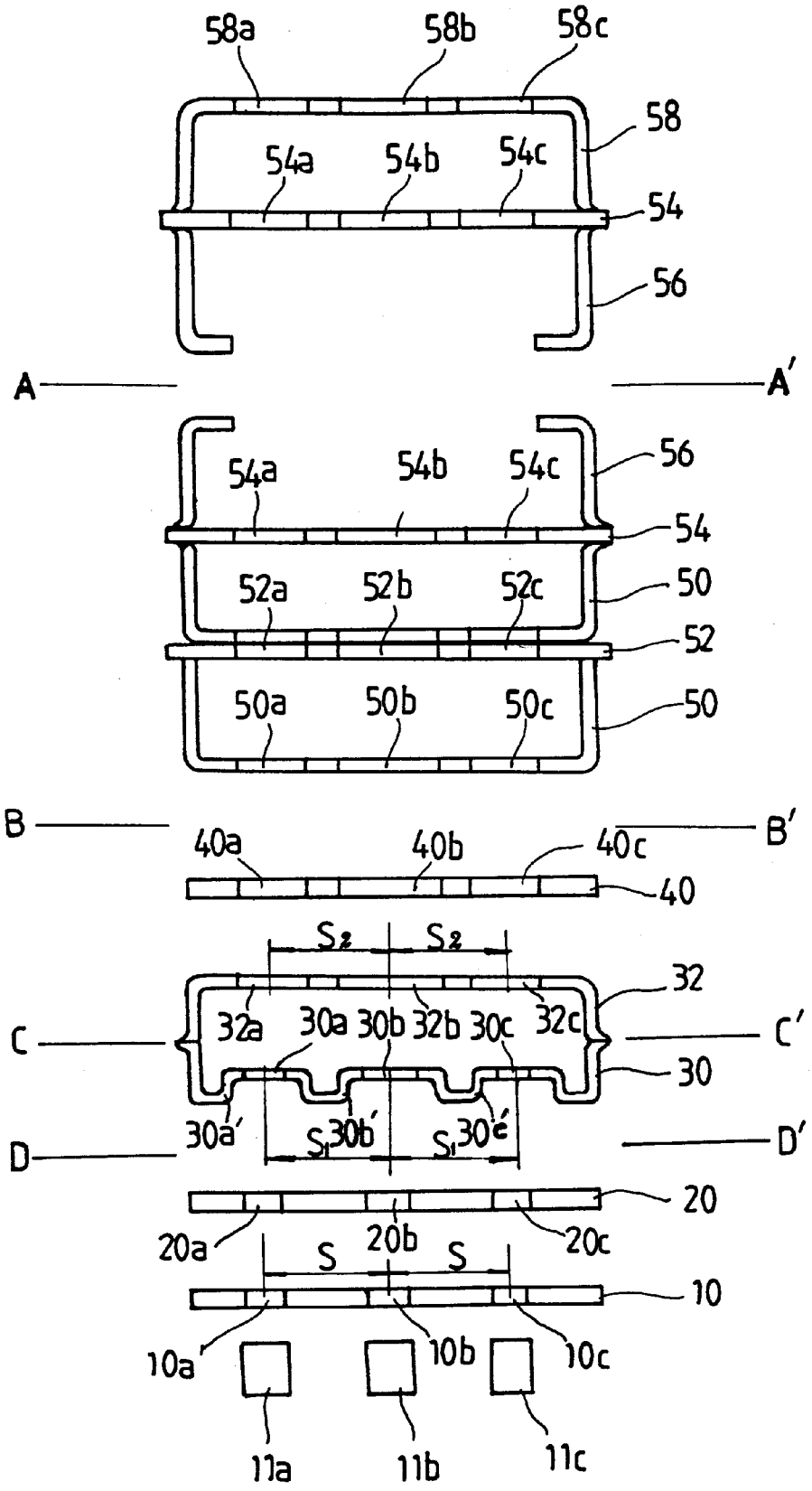
FIG. 9 is a sectional view of an in-line type electron gun according to another embodiment of the present invention, showing the construction and three axes of the electron gun.

FIG. 9 is a sectional view of an in-line type electron gun according to another embodiment of the present invention. As shown, the in-line type electron gun according to the present embodiment comprises three cathodes 11*a,* 11*b* and 11*c* for radiating three electron beams, a control grid electrode (G1) 10, screen grid electrodes (G2 and G4) 20 and 40, an accelerating grid electrode (G3) 30, a first main focusing electrode (G5) 50, 52, 54, and 56 disposed at the cathode side, and a second main focusing electrode 54, 56, and 58 disposed at the screen side.

In the electron gun, in order to facilitate static convergence of two side beams to the central beam, the apertures of the electrodes are formed in such a manner that a distance S from the center of the central aperture to the centers of the side apertures in the first and the second electrodes 10 and 20 is different from a corresponding distance S1 in the third electrode 30.

In other words, a first static convergence is achieved by making the pitch S1 larger than the pitch S to form a refractive lens. Meanwhile, when the electron beams pass through the third electrode 30 after the cross over point, slots 30*a*', 30*b*' and 30*c*' elongated in the vertical direction strengthen the diverging force of the beams in the horizontal direction, while weakening the diverging force of the beams in the vertical direction, which means the function of a quadrapole lens.

Each of the three slots 30*a*', 30*b*' and 30*c*' has the same size including a height of 8.8 mm, a width of 1.6 mm, and a depth of 0.4 mm.

A second static convergence is achieved by forming a pitch S2 of the apertures of an upper electrode 32 of the third electrode 30 smaller than the pitch S1, so that the side beams may be deflected toward the central beam.

A third static convergence is achieved by apertures 50*a,* 50*b* and 50*c* of the fifth electrode 50 which are larger than apertures 40*a,* 40*b* and 40*c* of the fourth electrode 40. This construction forms a nonsymmetric electrostatic lens to focus the side beams toward the central beam.

The third static convergence enables to employ the electrodes 54, 56, 58 and 60 of the same size which form the main focusing lenses.

Figure 10:
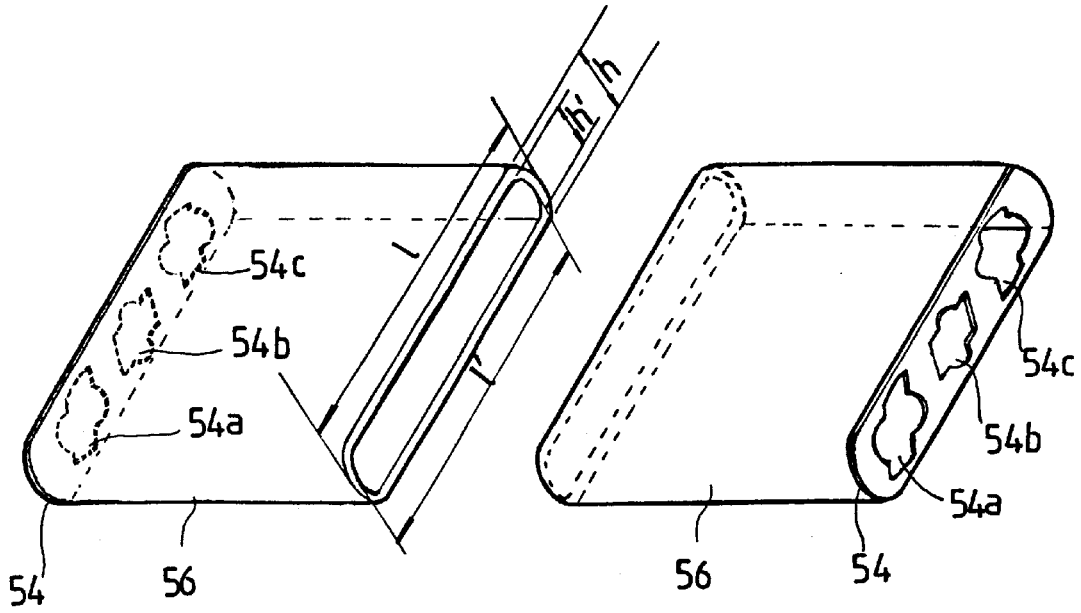
FIG. 10 is a schematic perspective view of a main lens of the electron gun shown in FIG. 9.

FIG. 10 is a schematic perspective view of the main focusing lens section disposed at either sides of line A–A' in FIG. 9. The main focusing lens section includes a fifth electrode 50 and a sixth electrode 58 opposed to each other. The fifth electrode 50 and the sixth lectrode 58 respectively have a plate electrode disposed back side of the opposing face. Each plate electrode has three apertures through which three electron beams of R, G and B pass.

Then, rim electrodes 56 and 56 are formed at the opposing sides of the fifth electrode 50 and the sixth electrode 58 in order to maximize the effective diameter of the main lens. The size l', h' of the rim electrodes 56 and 56 can be maximized to 86.5% of the size l, h which are the horizontal and vertical outermost sizes of the fifth electrode 50 and the sixth electrode 58.

These enlarged rim electrodes 56 and 56 provide an advantage that enlarged electro static lens can be formed by the enlarged rim electrodes 56 and 56 and the plate electrodes 54 and 54 connected thereto, thus having a minimized spherical aberration which eteriorates the resolution on the phosphor screen.

When the value of h' is set small in the electron gun employing an electrostatic focusing method, the electrodes forming the main lens must have apertures elongated as long as possible in the vertical direction. And the sixth electrode must have apertures smaller than vertical length of the aperture of the fifth electrode, in order to obtain beam spots elongated in the vertical direction rather than in the horizontal direction. When the vertical length of the apertures (54*a,* 54*b,* 54*c*) of the sixth electrode is shorter, the main lens reveals a strong convergence force in the vertical direction, so that the size of the beam spots is sensitively changed according to the change of the focusing voltage.

Figure 11:
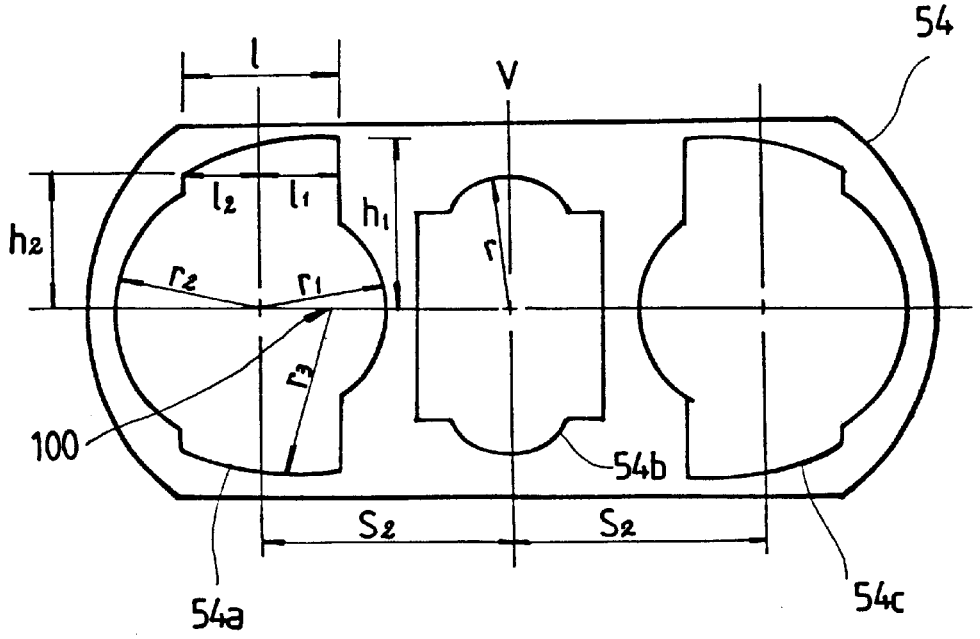
FIG. 11 is a front view of a plate electrode employed in the main lens shown in FIG. 10.

FIG. 11 is a front view of the plate electrode 54. The plate electrode 54 has a central aperture 54*b* of a rectangular shape with circular arcs respectively constituting portions of an upper and a lower segments of the rectangle in which each of the circular arcs has a radius r. The central aperture 54*b* having the above described shape makes core components increased in the total beam spots focused on the screen in the horizontal direction, and the circular arcs enable the control of the focusing intensity in the vertical direction.

Side apertures 54*a* and 54*c* respectively have a shape similar to a key hole which has two circular arcs with different radii respectively disposed at the central aperture side and at the rim electrode wall side.

Each of the side apertures 54*a* and 54*c* is contoured by two side circular arcs having different radii r1 and r2, straight lines extending vertically from either ends of each of the two side circular arcs, and an upper and a lower circular arcs respectively connecting the straight lines to each other at the upper and the lower electrodes. The upper and the lower circular arcs have the same radius r3 and the origin 100 of the radius r3 is disposed inside of the vertical axis of the side aperture toward the center aperture, preferrably on the horizontal axis thereof. Therefore, radii of three imaginary circles forming the above circular arcs fulfill an inequality, r1<r2<r3. The distances dr1, dr2 and dr3 from the vertical axis to the centers of the three imaginary circles have a relation which fulfills dr1=dr2<dr3 or dr1<dr2<dr3

The two side circular arcs arranged in the horizontal direction can be supported by a beading jig rod when the electron gun is assembled.

In order to control the focusing of the beams in the horizontal direction by simultaneously employing the fifth and the sixth electrodes 54 and 56 for the main focusing electrode, enlarged r1 and r2 and reduced l can increase core components by weakening the electrostatic lens to prevent over focusing in the horizontal direction.

Since the static convergence is performed at two place between G2 and G3 grid and between G5 and G6 grid before the electron beams reach the main focusing lens, the central beam is subject to a stronger focusing force in the horizontal direction than the side beams when the three electron beams reach the main focusing lens, so that the spots formed on the screen have more halo components at the inner portions than at the outer portions of the spots.

These halo components can be reduced or eliminated by forming the side apertures in such a manner that l1 become larger than l2 and h1 larger than h2, because the central portion of the main lens is intensified.

However, too large r1 may over-weaken the horizontal focusing force to cause an astigmatism and enlarge deflection of the side beams to deteriorate the static convergence characteristic.

The static focusing method requires vertically elongated beam spots in order to compensate for the broadening of the beams at the peripheral portions of the screen by the deflectional magnetic filed of the deflection yoke. In order to fulfill the above requirement, the values of l, h1 and h2 are enlarged. Further, the origin 100 disposed inside of the vertical axis of the side aperture, preferrably on the horizontal axis thereof, can reduce the excessive difference between focusing forces of the horizontal and the vertical directions, and the sensibility of the astigmatism can be minimized by properly selecting values of l1 and l2.

Figure 12:
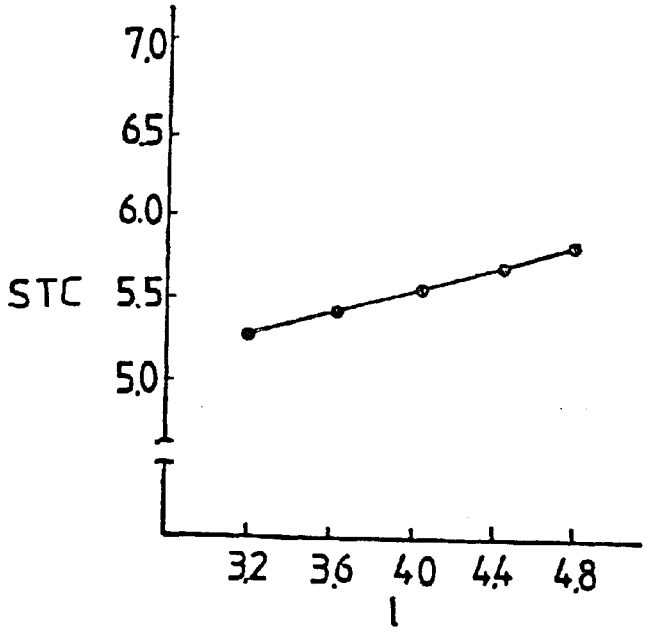
FIG. 12 to FIG. 14 are graphs respectively for showing the change of the static convergence according to the increase of values l, r1 and r2 in the plate electrode shown in FIG. 11.
Figure 13:
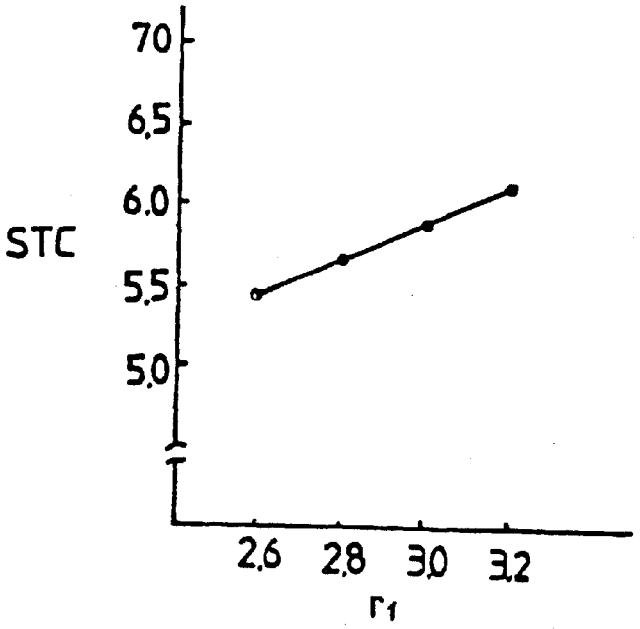
Figure 14:
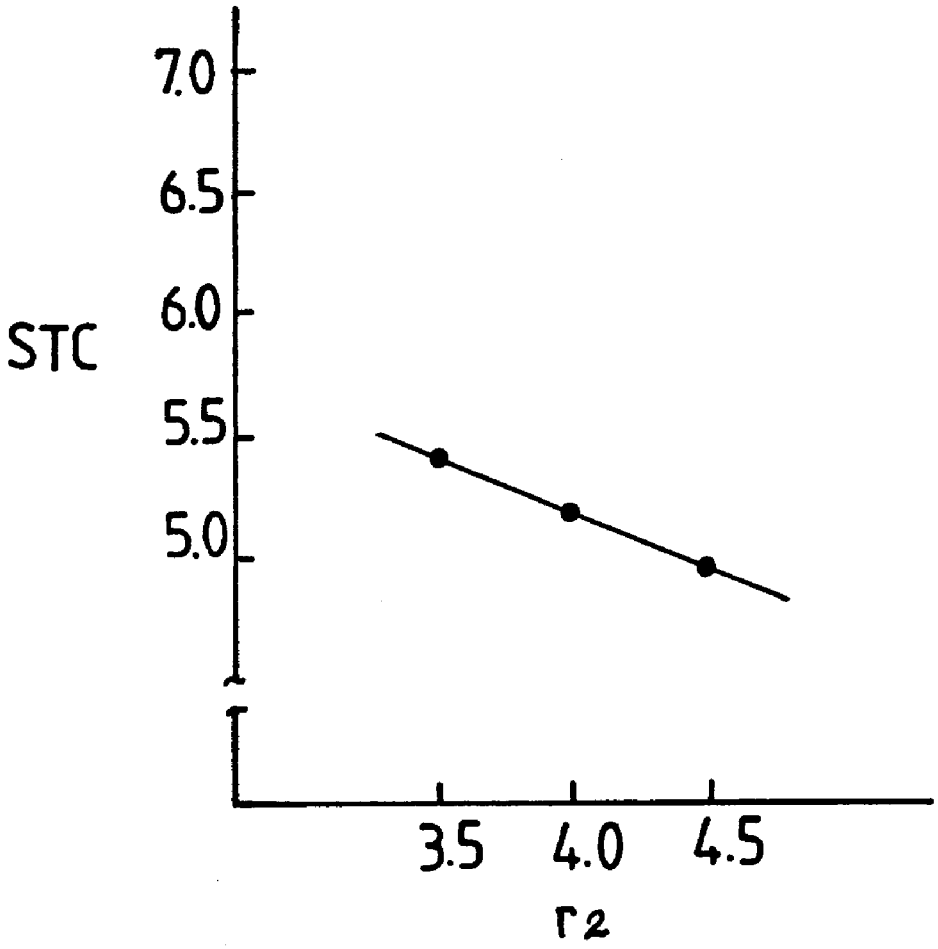

FIG. 12 to FIG. 14 respectively show the change of the static convergence according to the increase of the values l, r1 and r2.

Referring to FIG. 12 to FIG. 13, the increase of the value l rather than that of the value r1 enables a larger increase of the static convergence. Further, FIG. 14 shows that the static convergence decreases when the value r2 increases. Therefore, a desired static convergence is easily achieved by controlling the values l, r1 and r2. Furthermore, the halo components can be easily compensated with preventing the overfocusing by controlling the values l1 and r1.

Figure 15:
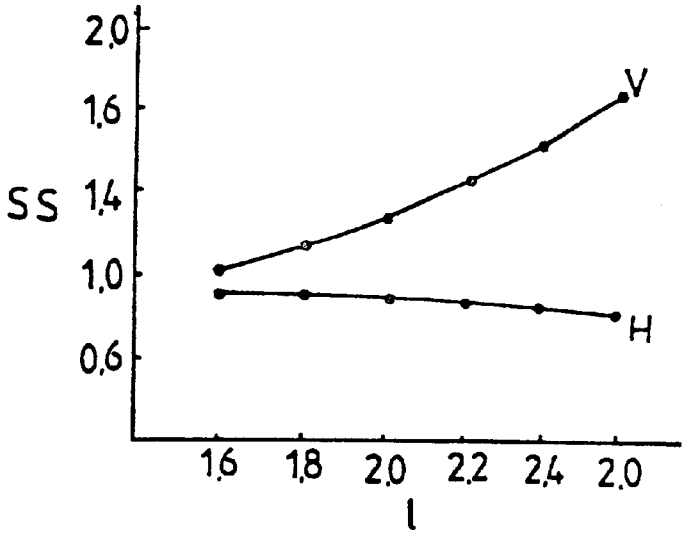
FIG. 15 is a graph for showing the change of the beam spots according to the value l at side apertures of the fifth and the sixth electrodes.

FIG. 15 shows the change of the beam spots when the value l is changed while the values r1, r2 and r3 are maintained constantly. FIG. 15 reveals that the spot changes small in the horizontal direction but large in the vertical direction when the value l increases, which means that an increased value l can reduce the astigmatism.

Figure 16:
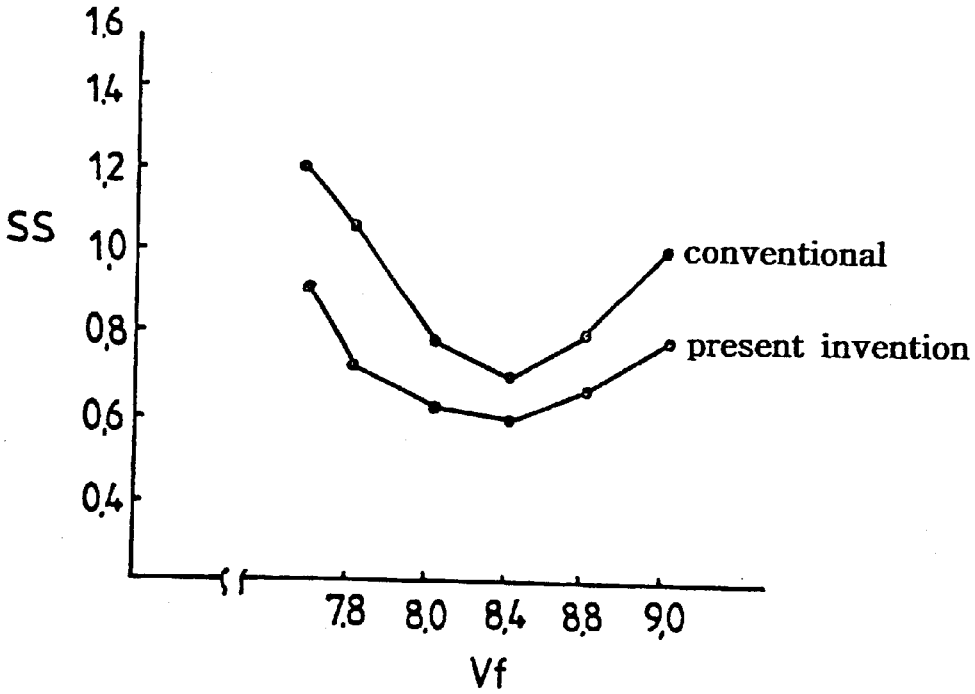
FIG. 16 is a graph for comparing the relation between the beam spots and the focusing voltage in the electron gun according to the present invention with that in the conventional electron gun.

FIG. 16 shows improved spot sizes of side beams described in table 3. As shown in FIG. 16, side apertures 54*a* and 54*c* of the plate electrode 54 can easily control the beam size and shape in all of the directions.

TABLE 3

| | |
|---|---|
| G1 Φ 0.64 mm | pitch 6.0 |
| G2 Φ 0.64 mm | pitch 6.0 |
| G2–G3 spacing 0.9 mm | |
| G3 Φ 1.2 mn | pitch 6.1 |
| G4 Φ 4.0 mm | pitch 5.9 |
| G3–G4 spacing 0.95 mm | |
| G5 Φ center 4.6 mm | pitch 5.9 |
| G5 Φ side 4.7 mm | |
| G5–G6 spacing 1.0 mm | |
| rim height 3.62 mm | |
| rim hole v-axis 9.0 mm | |
| rim hole h-axis 21.0 mm | |

According to the present invention as described above, there is provided an electron gun for a cathode ray tube which improves the degree of freedom in controlling shapes of beam spots focused on a phosphor screen, and which improves the resolution of the cathode ray tube.

In the electron gun of the present invention, an influence of cylindrical side walls of grid electrodes to electric fields of a main lens is reduced, thereby improving shapes of beam spots at peripheral portions of a phosphor screen and the focusing uniformity through central and peripheral portions of the phosphor screen.

The electron gun of the present invention has further advantages that the convergence drift according to the focus voltage variance is largely reduced, so that it is easy to maintain the white balance even when the luminance is largely changed, and which reduces a variance of the resolution according to a change of the cathode current.

In the electron gun of the present invention, halo components of the side beams can be reduced, and the astigmatism is minimized to improve the focusing characteristic and the static convergence characteristic.

While the present invention has been particularly shown and described with reference to the particular embodiments thereof, it will be understood by those skilled in the art that various changes in form and details may be effected therein without departing from the spirit and scope of the invention as defined by the appended claims.

What is claimed is:

1. An electron gun for a cathode ray tube comprising a plurality of grid electrodes for focusing electron beams radiated from cathodes, at least one of said grid electrodes having a cylindrical body containing a plate member, the plate member having a central aperture and two side apertures, at least one of the two side apertures being contoured by at least one curve, straight lines connected to the curve, and connecting lines connecting the straight lines; wherein said at least one of the two side aperture is contoured by a first circular arc and a second circular arc, two first vertical lines respectively extending outwardly from either ends of the first circular arc, two second vertical lines respectively extending outwardly from either ends of the second circular arc, and two connecting lines respectively connecting each of outer ends of the first vertical lines to each of outer ends of the second vertical lines, thereby providing a degree of freedom in controlling shapes of beam spots focused on a phosphor screen by controlling radii of the first, the second and the third circular arcs, the first circular arc being part of a first imaginary circle, and the second circular arc being part of a second imaginary circle, the first imaginary circle and the second imaginary circle being concentric circles, the first imaginary circle having a larger diameter than the second imaginary circle, the first circular arc and the second circular arc being opposed to each other, and the second circular are being disposed near the central aperture.

2. An electron gun for a cathode ray tube as claimed in claim 1, wherein the first imaginary circle and the second imaginary circle are eccentric to each other.

3. An electron gun for a cathode ray tube, the electron gun radiating three electron beams to be directed toward a phosphor screen through three apertures comprising a center aperture and two side apertures, the electron gun comprising at least two bipole electrodes opposed to each other, the two bipole electrodes forming a main lens for focusing the three electron beams, the two bipole electrodes respectively containing a plate electrode having said three apertures, the two bipole electrodes being rim electrodes having an equal size to each other, at least one side aperture of said three apertures being contoured by two side circular arcs having different first and second radii, two straight lines extending vertically from either end of each of the two side circular arcs, and an upper and a lower circular arc respectively connecting the straight lines to each other at upper and the lower portions of the at least one side aperture, the upper and the lower circular arcs having a same third radius and an origin of each third radius being inside a vertical axis of the at least one side aperture, toward the center aperture.

4. An electron gun for a cathode ray tube as claimed in claim 3, wherein the at least one side aperture has a first distance between a horizontal line connecting centers of the first and second radii and a junction between the upper circular arc and one of the straight lines which is furthest from the center aperture, is larger with respect to a second distance between the horizontal line and a junction between the upper circular arc and the other straight line, when the upper and lower circular arcs have an origin further from a center of the at least one side aperture than origins of the two side circular arcs.

5. An electron gun for a cathode ray tube as claimed in claim 3, wherein said first and second radii are smaller than said third radius, the two straight lines being spaced with different distances from the vertical axis of the at least one side aperture, and a height of an inside one of the straight lines being not less than a height of an outside one of the straight lines from a center of the at least one side aperture.

* * * * *